US006814473B2

(12) United States Patent
Chen

(10) Patent No.: US 6,814,473 B2
(45) Date of Patent: Nov. 9, 2004

(54) LAMP WITH HINGED ADJUSTABLE ARM STRUCTURE

(75) Inventor: Wen-Tsung Chen, Taipei Hsien (TW)

(73) Assignee: Gingko Industrial Co., Ltd., Taipei Hsien (TW)

( * ) Notice: Subject to any disclaimer, the term of this patent is extended or adjusted under 35 U.S.C. 154(b) by 37 days.

(21) Appl. No.: 10/308,023

(22) Filed: Dec. 3, 2002

(65) Prior Publication Data

US 2004/0105271 A1 Jun. 3, 2004

(51) Int. Cl.[7] ..... F21V 21/18

(52) U.S. Cl. ..... 362/402; 362/220; 362/371; 362/414; 362/424; 362/427

(58) Field of Search ..... 362/217, 220, 362/362, 368, 370, 371, 372, 382, 401, 402, 410, 413, 414, 418, 419, 422, 424, 425, 427, 428, 429, 430, 432; 248/560, 610, 121, 122.1, 123, 11, 124.1, 125.7, 127, 158, 161, 162.1, 157, 200, 274.1, 276.1, 278.1, 279.1, 280.11; 220/3.2, 3.8, 3.9, 3.92, 3.94, 4.01, 4.02, 485; 174/68.1, 68.3, 73.1, 95, 97

(56) References Cited

U.S. PATENT DOCUMENTS 737,997 A * 9/1903 Burk ..... 174/97
2,608,367 A * 8/1952 Boltuch ..... 248/569
2,885,460 A * 5/1959 Borresen et al. ..... 174/97
3,041,060 A * 6/1962 Jacobsen ..... 267/177
4,213,591 A * 7/1980 Jaakkola ..... 248/281.11
4,545,555 A * 10/1985 Koch ..... 248/280.11
5,158,361 A * 10/1992 Huang ..... 362/414
5,170,975 A * 12/1992 Chadwick ..... 248/284.1
5,333,103 A * 7/1994 Cvek ..... 362/413
5,544,028 A * 8/1996 Carlin ..... 362/249
6,033,088 A * 3/2000 Contigiani ..... 362/249
6,494,594 B1 * 12/2002 Schroetter ..... 362/249

* cited by examiner

*Primary Examiner*—Thomas M. Sember
*Assistant Examiner*—Ismael Negron
(74) *Attorney, Agent, or Firm*—Rosenberg, Klein & Lee

(57) ABSTRACT

A lighting structure includes a wire collector, a lamp head, a base and a balancing device. The wire collector includes a first supporting rod and a second supporting rod which are respectively integrally formed. The balancing device includes a first hinge, a first cord, a first elastic element, a second hinge, a second cord and a second elastic element. The first and second hinges respectively drive the first and second cords to tense or release the first and second elastic elements, while the first and second elastic elements hold the first and second supporting rods. A channel is formed on each of the first and second supporting rods for receiving a power line.

13 Claims, 7 Drawing Sheets

LAMP WITH HINGED ADJUSTABLE ARM STRUCTURE

BACKGROUND OF THE INVENTION

1. Field of the Invention

The invention relates to a lighting structure and, more particularly, to an adjustable lighting structure having a balancing device and a wire collector.

2. Description of the Related Art

A lighting, such as a desk lamp, always has an adjustable lamp. Referring to FIG. 1, a lighting includes a first supporting rod 1, a second supporting 2, a lamp head 3, a base 9 and a balancing device. The balancing structure includes a first hinge 4, a first spring 11, and a second spring 21. The first hinge 4 and the second hinge 7 are respectively provided with joints 43, 73, spring contacts 58, 76, and connecting rod contacts 59, 77. The joint 43 of the first hinge 4 is pivotally connected to a bottom of the first supporting rod 1. An upper end and a lower end of the first, spring 11 are respectively connected to the first supporting rod 1 and the spring contact 58 of the first pivot 4. The joint 73 of the second hinge 7 is pivotally connected to an upper end of the first supporting rod 1 and a lower end of the second supporting rod 2. An upper end and a lower end of the second spring 21 are respectively to the second supporting rod 2 and the spring contact 76 of the second hinge 7. The connecting rod contacts 59, 77 of the first and second hinges 1, 7 are pivotally connected to a connecting rod 82. An lower end of the first supporting rod 1 and an upper end of the second supporting rod 2 are respectively connected to the base 9 and the lamp head 3. The lamp head 3 has a bulb (not shown) therein and electrically connected to a power line 34 which extends to the base 9 through the first and second supporting rods 1, 2.

When the conventional lighting is to be moved, the pivotal connection between the first and second supporting rods allows the lighting to move up and down. However, the relative location of the joints 43, 73, spring contacts 58, 76, and connecting rod contacts 59, 77 is not changable, which makes the operation of the supporting rods not smooth. Furthermore, since the power line has to be arranged in the supporting rods, assembly of lighting is troublesome. Different type of lightings need different lamp heads and supporting rods, thereby a lot of hardwares are needed for assembling such lamp heads and supporting rods. Therefore, the total cost of lighting manufacture is high.

SUMMARY OF THE INVENTION

It is an object of the invention to provide a lighting structure that is operated more smoothly.

It is another object of the invention to provide a lighting structure that a lamp head and a power line are assembled/dissembled with ease to increase the productivity, a supporting rod used in the lighting structure can be applied to various type of lamp head, thereby the total cost of lighting manufacture being reduced.

In order to achieve the above and other objectives of the invention, a lighting structure including a wire collector, a lamp head, a base and a balancing device is provided. The wire collector includes a first supporting rod and a second supporting rod which are respectively integrally formed. The balancing device includes a first hinge, a first cord, a first elastic element, a second hinge, a second cord and a second elastic element.

The first hinge is mounted between the first supporting rod and the base. The first hinge includes a base attaching arm, a first pivoting member and a first connecting arm, all of which are pivotally connected to one another by a first connecting piece. A lower end of the first cord is secured onto the first pivoting member of the first hinge. A lower end of the first elastic element is connected to an upper end of the first cord. The second hinge is mounted between the first and second supporting rods. The second hinge includes a second connecting arm, a second pivoting member and a third connecting arm, all of which are pivotally connected to one another by a second connecting piece. One end of the second connecting arm is secured on the first elastic element, a connecting rod respectively connecting the first and second hinges. The lamp head is mounted on an upper end of the second supporting rod. A lower end of the second cord is secured on the second pivoting member of the second hinge. A lower end of the second elastic element is connected to an upper end of the second cord.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
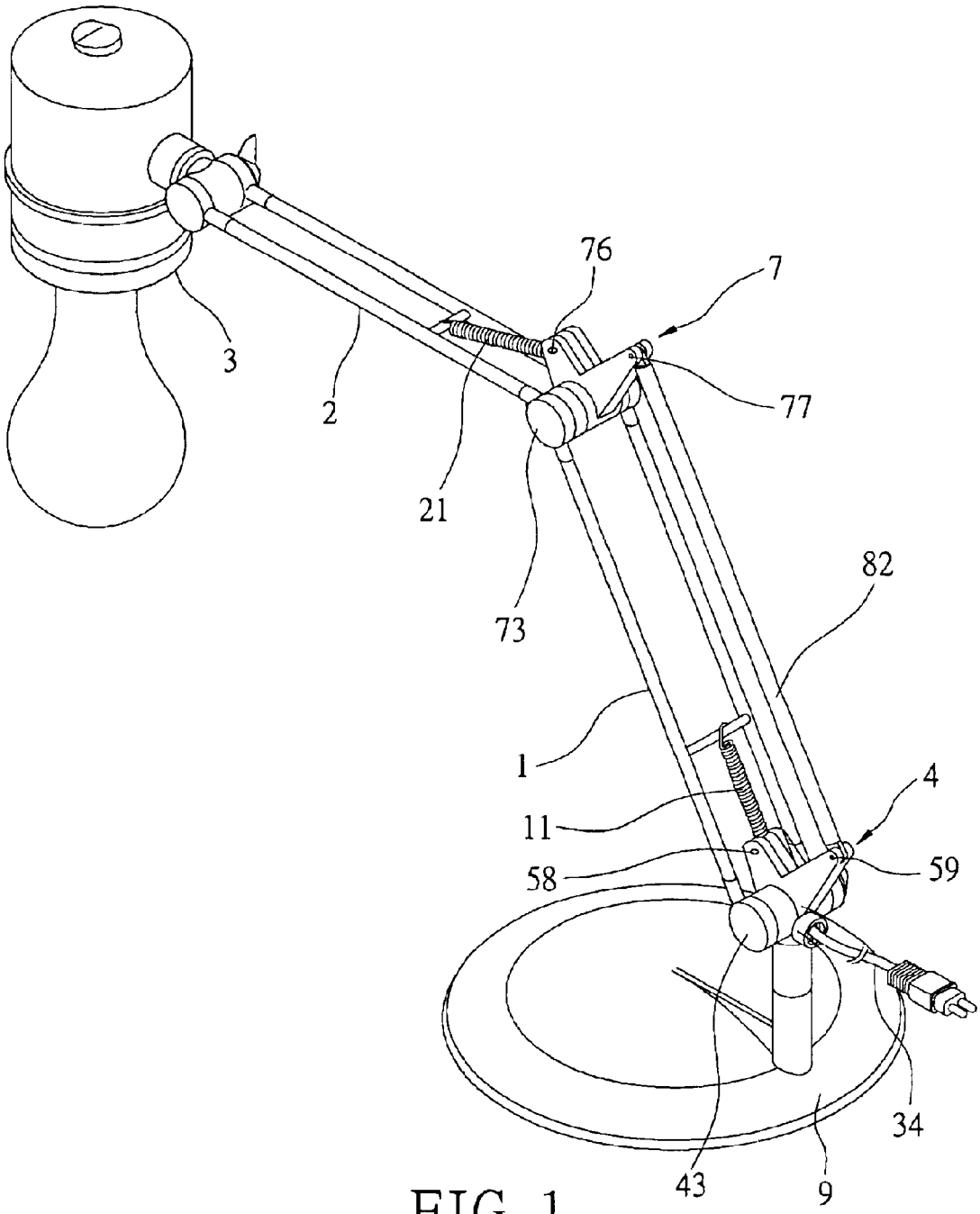
FIG. 1 PRIOR ART
FIG. 1 is a perspective view of a conventional lighting.

Wherever possible in the following description, like reference numerals will refer to like elements and parts unless otherwise illustrated.

Figure 2:
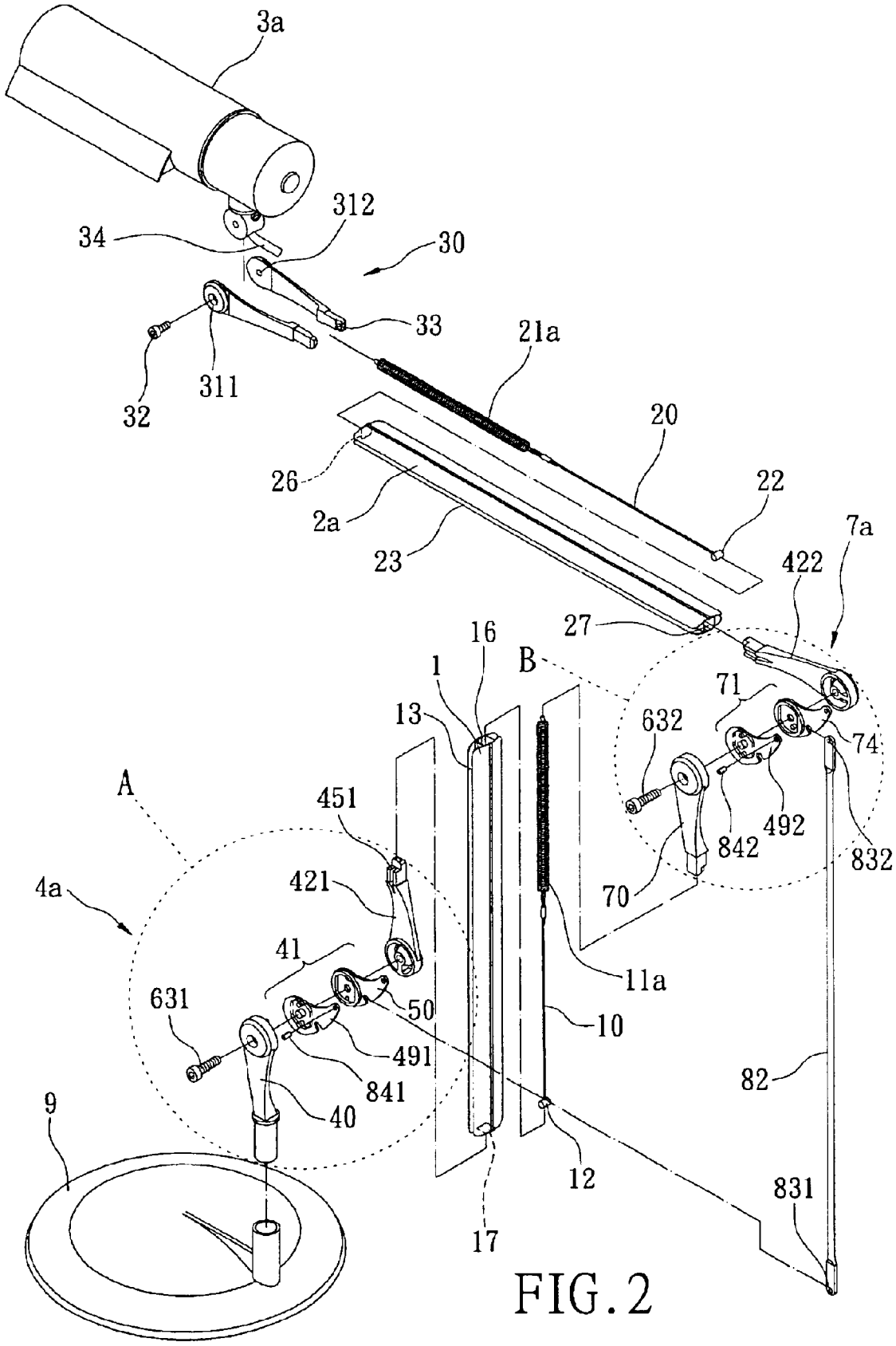
FIG. 2 is an exploded view of a lighting structure according to one embodiment of the invention.
Figure 3:
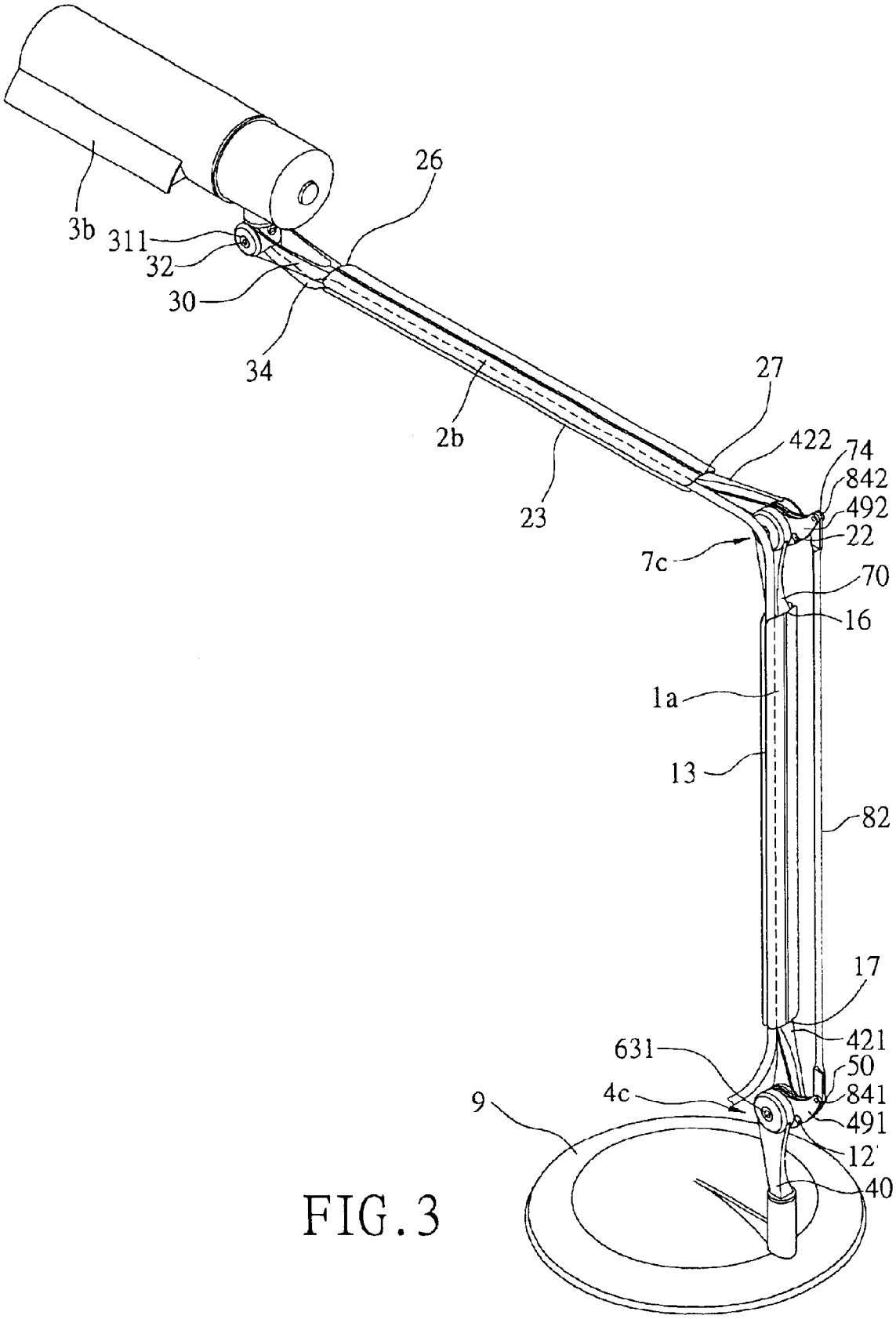
FIG. 3 is a perspective view of a lighting structure according to one embodiment of the invention.
Figure 4:
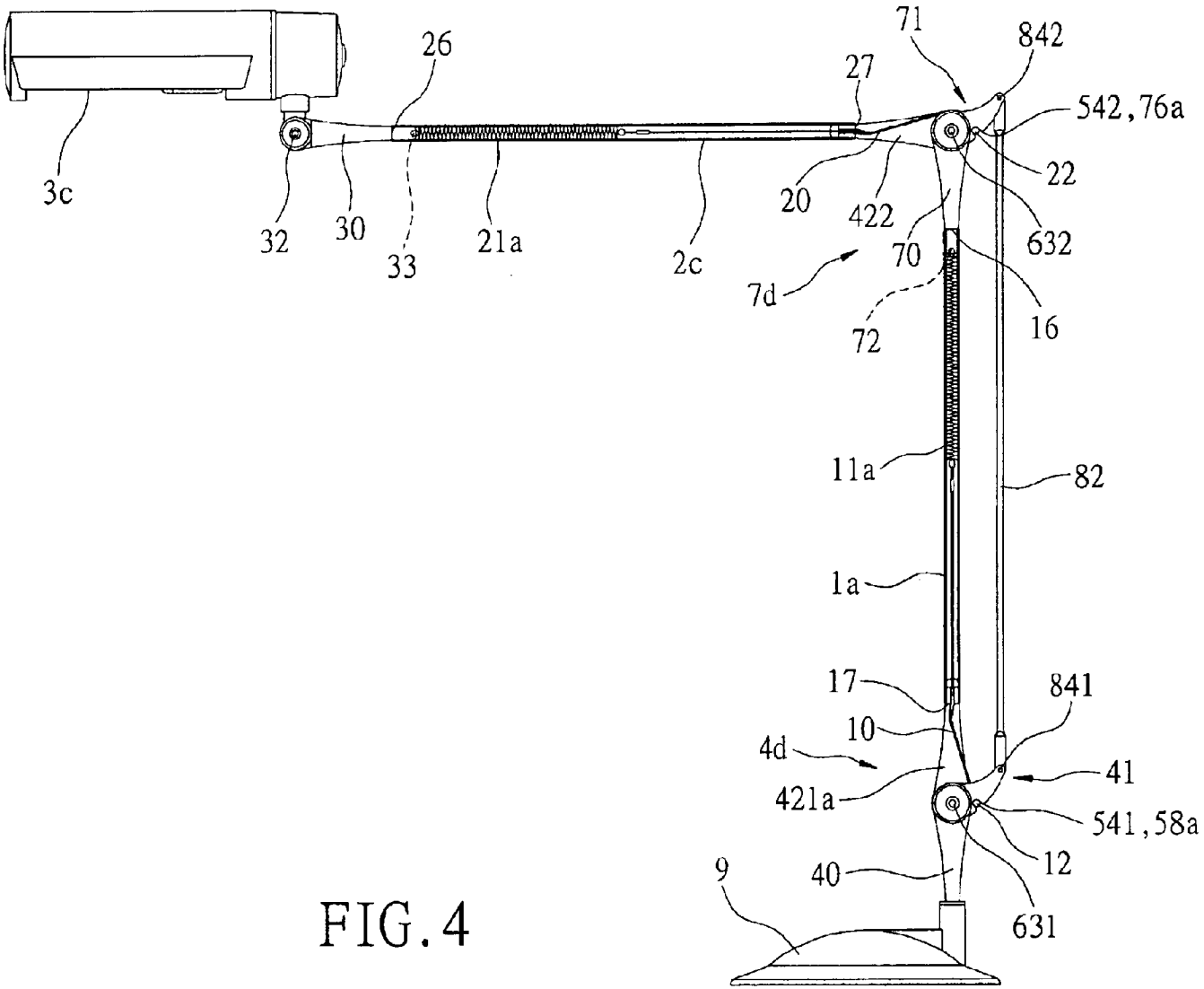
FIG. 4 is a cross-sectional view of a lighting structure according to one embodiment of the invention.

Referring to FIG. 2 through FIG. 4, a lighting structure includes a wire collector, a lamp head 3, a base 9, and a balancing device.

Figure 5:
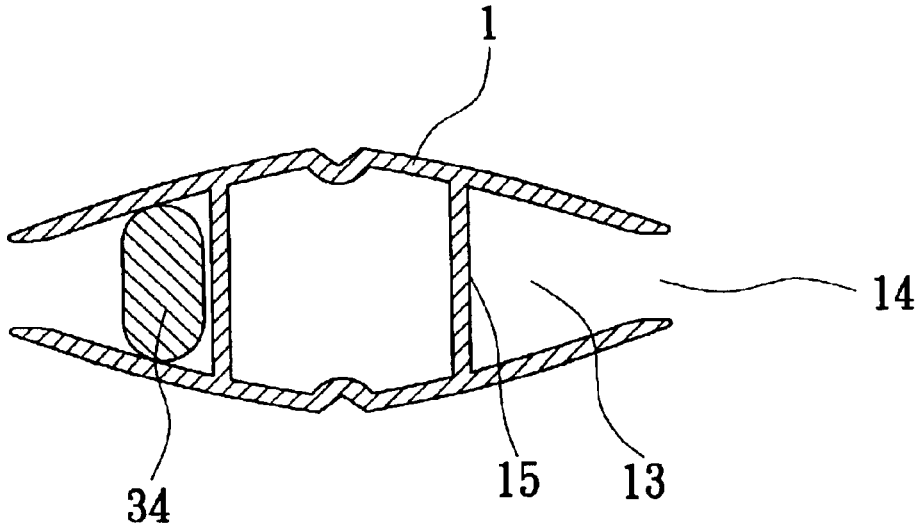
FIG. 5 is a cross-sectional view of a lighting structure according to one embodiment of the invention.

The wire collector includes a first supporting rod 1 and a second supporting rod 2, which are, for example, integrally formed in a single body. The first supporting rod 1 has a channel 13 that includes a top opening 14 and a bottom 15, as shown in FIG. 5. A diameter of the top opening 14 is smaller than a width of the bottom 15. The second supporting rod 2 has the same structure as the supporting rod 1. Furthermore, the first supporting rod 1 has a first front opening 16 and a first tail opening 17. The second supporting rod 2 has a second front opening 26 and a second tail opening 27.

The lamp head 3 has a bulb therein (not shown) which is electrically connected to a power line 34. The power line 34 extends from the end of the lamp head 3 through the first and second supporting rods 1, 2 to the base 9.

The balancing device includes a first hinge 4, a first cord 10, a first resilient element 11*a*, a second hinge 7, a second cord 20 and a second resilient element 21*a*.

Figure 2A:
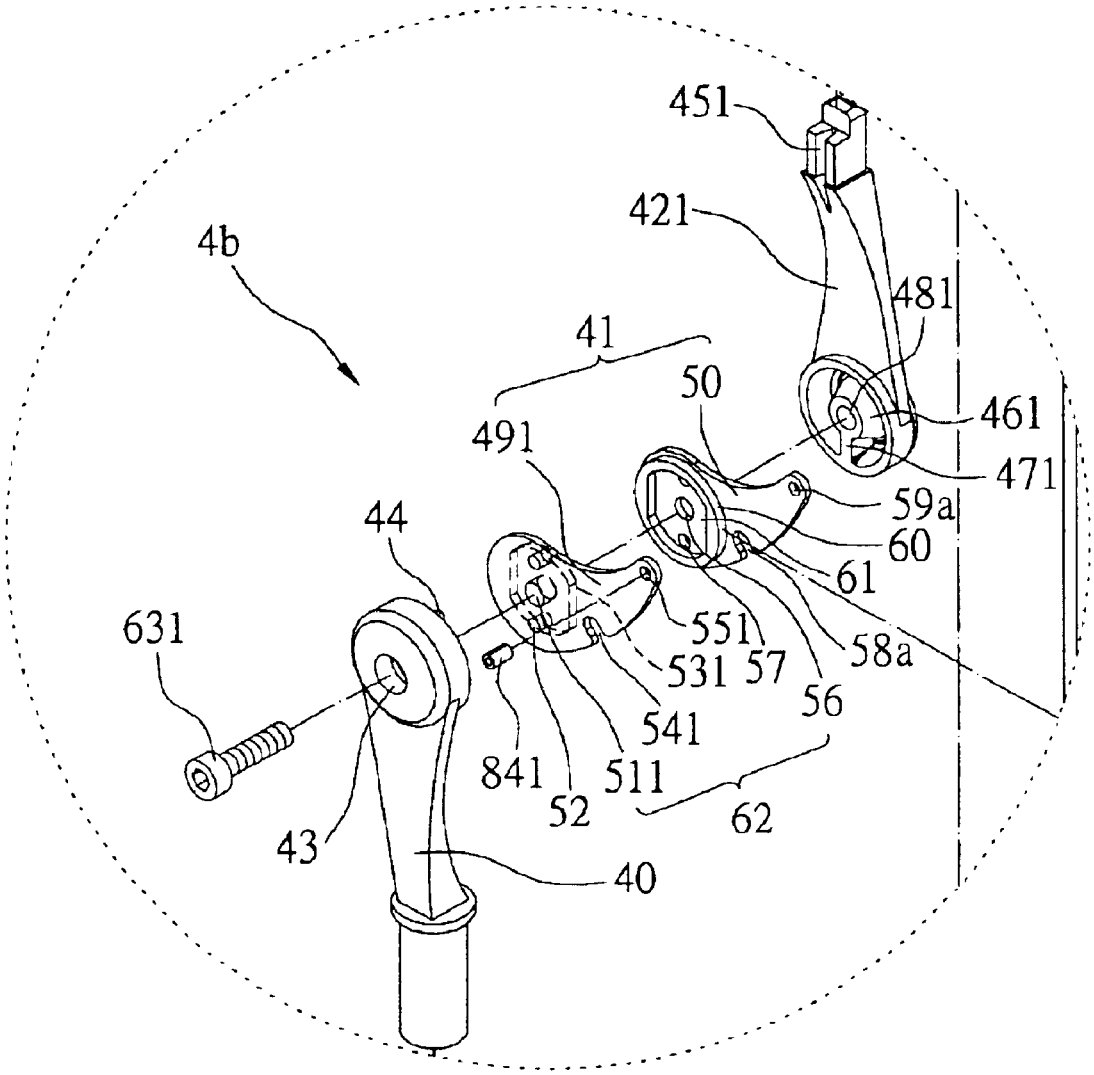
FIG. 2A is an enlarged view of part A of FIG. 2.

As shown in FIG. 2A, the first hinge 4 is mounted between the first supporting rod 1 and the base 9. The first hinge 4 includes a base attaching arm 40, a first pivoting member 41 and a first connecting arm 421. One end of the base attaching arm 40 is inserted into the base 9; and the other end of the base attaching arm 40 is provided with a pivoting hole 43 and a protuberance 44. A channel 451 is formed on one end of the first connecting arm 421, through which the first connecting arm 421 is inserted in the first tail opening 17. A circular groove 461 is formed on the other end of the first connecting arm 421, with a positioning section 471 being connected with ends of the circular groove 461. A pivoting hole 481 is surrounded by the circular groove 461. Furthermore, the first pivoting member 41 is located between the base attaching arm 40 and the first connecting arm 421. The first pivoting member 41 includes a first male piece 491 an a first female piece 50 arranged in a form of a cam. The first male piece 491 has a pivoting hole 511 and a through hole 52. The first male piece 491 has a protruding portion 531 on its front surface and a notch 541 at its edge. A pin hole 551 is formed through the first male piece 491. The first female piece 50 has a pivoting hole 56, a through hole 57, notch 58*a* and a pin hole 59*a* are formed a manner that respectively correspond to the pivoting hole 511, the through hole 52, the notch 541 and the pin hole 551 of the first male piece 491. On a rear surface of the first female piece 50 which faces the front surface of the first male piece 491, a disk 60 that has a recess 61 for receiving the protruding portion 531 of the first male piece 491. The pivoting hole 511 of the first male piece 491 and the pivoting hole 56 of the first female piece 50 form a pivoting hole 62 of the first pivoting member 41. A connecting piece 631 pivotally connects the pivoting holes 43,62,481 of the base attaching arm 40, the first pivoting member 41 and the first connecting 421 so that the first pivoting member 41 is located between the base attaching arm 40 and the first connecting arm 421. The protuberance 44 of the base attaching arm 40 penetrates through the through holes 52, 57, and rests in the circular groove 461 of the first connecting arm 421 of the first hinge 4.

The first cord 10, such as a rigid cable, is arranged inside the first supporting rod 1 and penetrated through the first tail opening 17 of the first supporting rod 1. A first fixing piece 12 is mounted on a lower end of the first cord 10 and is engaged with the notches 541, 58*a* of the first male piece 491 and the first female piece 50 of the first hinge 4. As soon as the end portion of the first cord 10 is arranged in the channel 451 of the first connecting arm 421, it slidablely attaches to the first female piece 50 outside the disk 60.

The first elastic element 11*a*, such as a spring, is mounted inside the first supporting rod 1, a lower end of the first elastic element 11*a* being connected to an upper end of the first cord 10.

Figure 2B:
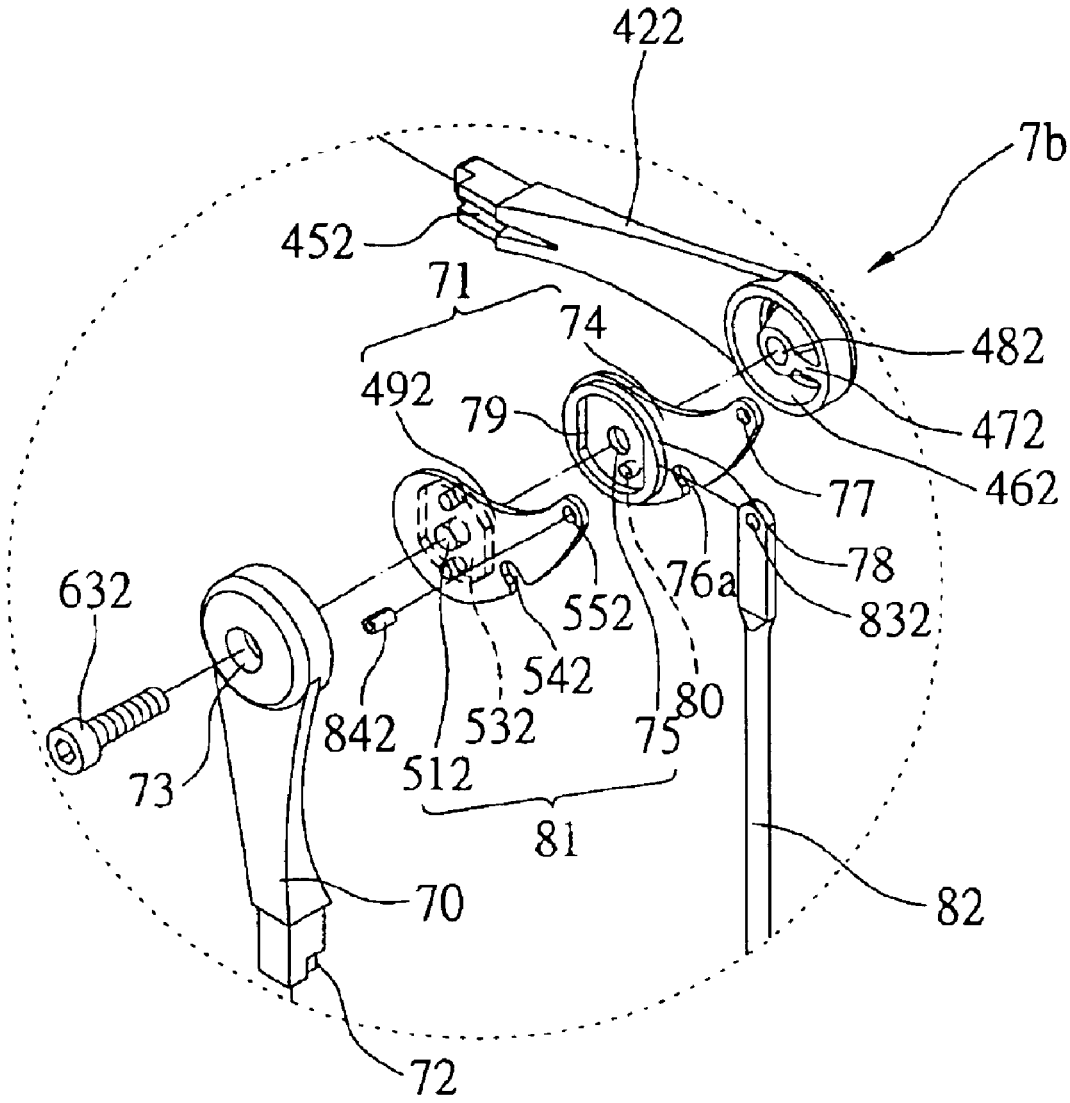
FIG. 2B is an enlarged view of part B of FIG. 2.

The second hinge 7, as shown in FIG. 2B, is arranged between the first supporting rod 1 and the second supporting rod 2. The second hinge 7 includes a second connecting arm 70, a second pivoting member 71 and a third connecting arm 422. One end of the second connecting arm 70 is inserted in the first front opening 16 of the first supporting rod 1 and has a protuberance 72 for engaging the first elastic element 11*a*. A pivoting hole 73 is formed at the other end of the second connecting arm 70. Similar to the first connecting arm 421, the third connecting arm 422 has a channel 452, a circular groove 462, a positioning point 472 and a pivoting hole 482. One end of the third connecting arm 422 is inserted in the second tail opening 27 of the second supporting rod 2. The lamp head 3 is mounted on an upper end of the second supporting rod 2. The second pivoting member 71 is located between the second connecting 70 and the third connecting arm 422. The second pivoting member 71 includes a second male piece 492 and a second female piece 74 arranged in a form of cam. Similarly to the first male piece 491, the male piece 492 includes a pivoting hole 512 and has a protruding portion 532 on its front surface and a notch 542 at its edge. A pin hole 552 is formed through the second male piece 492. The second female piece 74 has a pivoting hole 75, a notch 76*a* and a pin hole 77*a* are formed a manner that respectively correspond to the pivoting hole 512, the notch 542 and the pin hole 552 of the second male piece 492. A disk 78 protrudes from a surface of the second female piece 74. The disk 78 has a positioning slot 79 for receiving the protruding portion 532. The positioning slot 79 has a protuberance 80. The pivoting hole 512 of the second male piece 492 and the pivoting hole 75 of the second female piece 74 form a pivoting hole 81 of the second pivoting member 71. The connecting piece 632 pivotally connects the pivoting holes 73, 81, 482 of the second connecting arm 70, the second pivoting member 71 and the third connecting arm 422 so that the second pivoting member 71 is located between the second rod attaching arm 70 and the third connecting arm 422, and the protuberance 80 on the second female piece 74 is attached to the circular groove 462 of the third connecting arm 422. A connecting rod 82, which has pin holes 832, 831 respectively on end portions thereof, pivotally connects the pin hoes 552, 77*a* of the second male piece 492 and second female piece 74 of the second pivoting member 71 of the second hinge 7 to the pin holes 551, 59*a* of the first male piece 491 and the first female piece 50 of the first pivoting member 41 of the first hinge 4 respectively by pins 842,841.

The second cord 20, such as a rigid cable, is arranged inside the second supporting rod 2 and penetrated through the second tail opening 27 of the second supporting rod 2. A second fixing piece 22 is mounted on a lower end of end second cord 20 and is engaged in the notches 542, 76*a* of the second male piece 492 and the second female piece 74 of the second hinge 7. As soon as the end portion of the second cord 20 is arranged in the channel 452 of the third connecting arm 422, it slidablely attaches to the second female piece 74 outside the disk 78.

The second elastic element 21*a*, such as a spring, is mounted inside the second supporting rod 2, a lower end of the second elastic element 21*a* being connected to an upper end of the second cord 20. At an upper end of the second elastic element 21*a* is mounted a lamp connector 30 which has pivoting holes 311, 312 at it top. The lamp connector 30 is pivotally connected to the lamp head 3 by a connecting part 32. A bottom of the lamp connector 30 is inserted through the second front opening 26 of the second supporting rod 2 and has a protuberance 33 for engaging the second elastic element 21*a*.

When the lamp head 3 is moved, the notches 541, 58*a*, 542, 76*a* of the first pivoting member 41 and the second pivoting member 71 drive the fixing pieces 12, 22 of the first cord 10 and the second cord 20 to tense the elastic elements 11*a*, 21*a*, for holding the lamp head 3, the first supporting rod 1 and the second supporting rod 2. The protuberances 44, 80 of the first pivoting member 41 and the second pivoting member 71 are moved relative to the circular grooves 461, 462 of the first connecting arm 421 and the third connecting arm 422, the movement thereof being limited by the positioning sections 471, 472. Since the first cord 10 and the second cord 20 are respectively slidablely attached to the first female piece 50 and the second female piece 74 outside the disks 60,78, more smooth movement of the lamp head 3 and the supporting rods 1,2 and more easily stretching of the second elastic element 21*a* by the connecting rod 82 can be achieved.

With referring to FIG. 5, the power line 34 is arranged in the channel 13 of the first supporting rod 1 from the top opening 14. The top opening 14 has a diameter smaller than the power line 34 to prevent the power line 34 from falling off. However, the power line 34 having a flexible plastic coat is easily manually pushed into the channel 13. Since the second supporting rod 2 has the same structure of the first supporting rod 1, the power line 34 is also easily manually pushed into a channel 23 of the second supporting rod 2. When a lighting with a different lampshade is to be manufactured, the lamp channels 13, 23 of the first and second supporting rods 1, 2.

The first and second supporting rods 1, 2 have same simple structure and therefore can be put into mass production with ease. Therefore, the lighting can be assembled with a reduced assembly cost. Furthermore, the power line 34 is easily arranged into and removed from the first and second supporting rods 1, 2, which allows a user to assemble the lighting by himself/herself or replace the lamp head.

Figure 6:
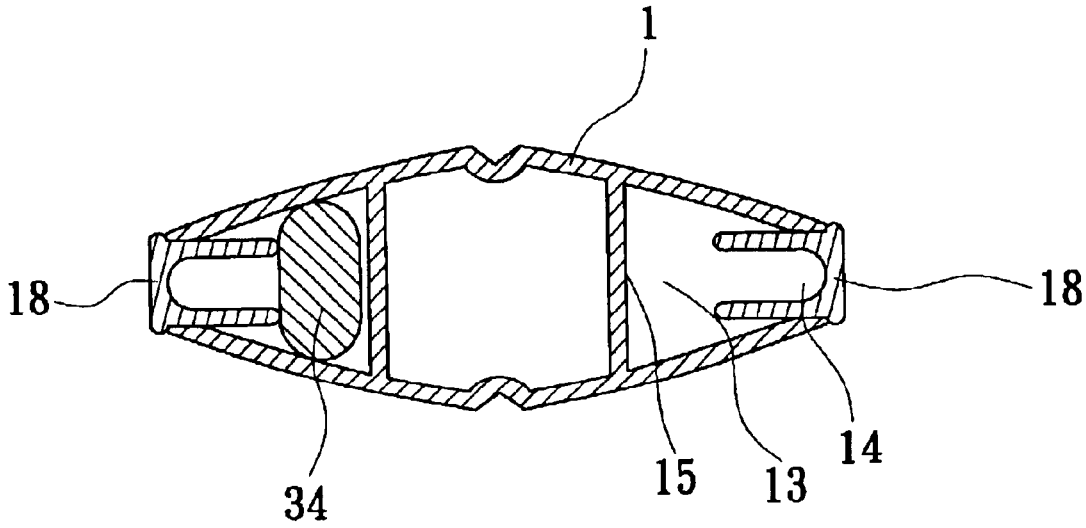
FIG. 6 is a cross-sectional view of a lighting structure with an ornamental accessory according to one embodiment of the invention.

Referring to FIG. 6, after the power line 34 is arranged inside the channel 13 of the first supporting rod 1, an ornamental accessory 18 can be mounted on the first or/and second supporting rods 1, 2.

In view of the above, the lighting structure of the invention has the following advantages:

1. Since the cords are respectively slidablely attached to the pivoting pieces outside the disks, more smooth movement of the lamp head and the supporting rods and more easily stretching of the second elastic element by the connecting rod can be achieved.

2. With the configuration of the channel of the supporting rod, the power line is easily manually arranged into and removed from the first and second supporting rods. Furthermore, the first and second supporting rods 1, 2 have same simple structure and therefore can be mass produced with ease. Therefore, the lighting can be assembled with a reduced assembly cost.

Those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A lighting structure comprising:

a wire collector further comprising a first supporting rod and a second supporting rod which are respectively integrally formed, a lamp head, a base, and a balancing device further comprising:

a first hinge mounted between the first supporting rod and the base, wherein the first hinge includes a base attaching arm, a first pivoting member and a first connecting arm, all of which are pivotally connected to one another by a first connecting piece;

a first cord, wherein a lower end of the first cord is secured onto the first pivoting member of the first hinge;

a first elastic element, wherein a lower end of the first elastic element is connected to an upper end of the first cord;

a second hinge mounted between the first and second supporting rods, wherein the second hinge includes a second connecting arm, a second pivoting member and a third connecting arm, all of which are pivotally connected to one another by a second connecting piece, one end of the second connecting arm being secured on the first elastic element, a connecting rod respectively connecting the first and second hinges, and the lamp head being mounted on an upper end of the second supporting rod;

a second cord, wherein a lower end of the second cord is secured on the second pivoting member of the second hinge; and a second elastic element, wherein a lower end of the second elastic element is connected to an upper end of the second cord.

2. The lighting structure of claim 1, wherein the first elastic element is arranged inside the first supporting rod.

3. The lighting structure of claim 1, wherein the first cord and the second cord are rigid cables, and the first and second elastic element are spring.

4. The lighting structure of claim 1, wherein the first and second supporting rods respectively have a channel thereon that a top opening thereof is smaller than a width of a bottom thereof.

5. The lighting structure of claim 4, wherein the channel is further provided with an ornamental accessory.

6. The lighting structure of claim 1, wherein one end of the base attaching arm is inserted into the base, and the other end of the base attaching arm is provided with a pivoting hole, one end of the first connecting arm is inserted in a lower end of the first supporting rod, the other end of the first connecting arm is provided with a pivoting hole, the first pivoting member of the first hinge has a pivoting hole and is arranged between the first and first connecting arms, and the first connecting piece penetrates through the pivoting holes of the base attaching arm, the first pivoting member and the first connecting arm.

7. The lighting structure of claim 6, wherein a protuberance is further formed on the base attaching arm of the first hinge, a circular groove and a positioning hole are formed in the base attaching arm of the first hinge, the first pivoting member includes a first female piece and a first male piece arranged in a form of a cam, the first male piece has a protruding portion thereon and has a pivoting hole and a through hole through it, the first female piece has a pivoting hole, a through hole, a notch and a pin hole are formed a manner that respectively correspond to the pivoting hole, the through hole, the notch and the pin hole of the first male piece, the pivoting holes form a hinge of the pivoting member, the protuberance of the base attaching arm penetrates through the through holes of the male and female piece and rests in the circular groove of the first connecting arm.

8. The lighting structure of claim 3, wherein the notches are respectively formed at edges of the first male piece and the first female piece, corresponding to each other, the first cord is arranged inside the first supporting rod, on a lower end of the first cord is formed a first fixing piece that is engaged with the notches of the first male piece and the first female piece and slidably attached to the first female piece outside the disk.

9. The lighting structure of claim 1, wherein one end of the second connecting arm of the second hinge is inserted into an upper end of the first supporting rod and has a protuberance for engaging the first elastic element, a pivoting hole is formed at the other end of the second connecting arm, one end of the third connecting arm of the second hinge is inserted into a lower end of the second supporting rod, the other end of the third connecting arm is provided with a pivoting hole, the second pivoting member of the second hinge has a pivoting hole and is arranged between the first and first connecting arms, and the second connecting piece penetrates through the pivoting holes of the second connecting arm, the second pivoting member and the third connecting arm.

10. The lighting structure of claim 9, wherein the second pivoting member includes a second female piece and a second male piece arranged in a form of a cam, the second male piece has a protruding portion thereon and has a pivoting hole, the second female piece has a pivoting hole corresponding to the pivoting hole of the second male piece, a disk having a positioning slot for receiving the protruding portion of the second male piece, the positioning slot has a protuberance opposite to the disk, the pivoting hole of the second male piece and the pivoting hole of the second female piece form a pivoting hole of the second pivoting member, the protuberance of the positioning slot on the second female piece is inserted in a circular groove of the third connecting arm.

11. The lighting structure of claim 10, wherein the notches are respectively formed at edges of the second male piece and the second female piece, corresponding to each other, the second cord is arrange inside the second supporting rod, on a lower end of the second cord is formed a second fixing piece that is engaged with the notches of the second male piece and the second female piece and slidably attached to the second female piece outside the disk.

12. The lighting structure of claim 11, wherein the second elastic element is arranged inside the second supporting rod, at an upper end of the second elastic element is mounted a lamp connector which has pivoting holes at it top, the lamp connector is pivotally connected to the lamp head by a connecting part, a bottom of the lamp connector is inserted in a top portion of the second supporting rod and has a protuberance for engaging the second elastic element.

13. A balancing device used in a lighting structure, comprising:

a first hinge mounted between a first supporting rod and a base, wherein the first hinge includes a base attaching arm, a first pivoting member and a first connecting arm, all of which are pivotally connected to one another by a first connecting piece;

a first cord, wherein a lower end of the first cord is secured onto the first pivoting member of the first hinge;

a first elastic element, wherein a lower end of the first elastic element is connected to an upper end of the first cord;

a second hinge mounted between the first and second supporting rods, wherein the second hinge includes a second connecting arm, a second pivoting member and a third connecting arm, all of which are pivotally connected to one another by a second connecting piece, one end of the second connecting arm being secured on the first elastic element, and a connecting rod respectively connecting the first and second hinges;

a second cord, wherein a lower end of the second cord is secured on the second pivoting member of the second hinge; and a second elastic element, wherein a lower end of the second elastic element is connected to an upper end of the second cord.

* * * * *